US007441294B2

(12) United States Patent
Mossbeck

(10) Patent No.: US 7,441,294 B2
(45) Date of Patent: Oct. 28, 2008

(54) BEDDING OR SEATING PRODUCT HAVING INFLATABLE CONCENTRIC AIR BLADDERS

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 80 days.

(21) Appl. No.: 11/625,381

(22) Filed: Jan. 22, 2007

(65) Prior Publication Data

US 2008/0172797 A1 Jul. 24, 2008

(51) Int. Cl.
*A47C 20/00* (2006.01)

(52) U.S. Cl. ..... 5/654; 5/713; 5/710; 5/655.3; 297/452.41

(58) Field of Classification Search ..... 5/710, 5/713, 653, 654, 655.3; 297/200, 452.41
See application file for complete search history.

(56) References Cited

U.S. PATENT DOCUMENTS

| | | | | | |
|---|---|---|---|---|---|
| 2,434,641 | A | * | 1/1948 | Burns | 267/117 |
| 2,919,747 | A | * | 1/1960 | Post | 428/102 |
| 3,983,587 | A | | 10/1976 | Gorran | |
| 4,445,240 | A | | 5/1984 | Voorhees | |
| 4,459,714 | A | * | 7/1984 | Lin | 5/655.3 |
| D284,139 | S | | 6/1986 | Ko | |
| 4,592,589 | A | | 6/1986 | Hellwig | |
| 5,046,205 | A | | 9/1991 | Garcia | |
| 5,079,785 | A | * | 1/1992 | Garcia | 5/654 |
| 5,379,471 | A | | 1/1995 | Holdredge | |
| 5,500,965 | A | | 3/1996 | Hannagan et al. | |
| 5,509,155 | A | * | 4/1996 | Zigarac et al. | 5/655.3 |
| 5,634,223 | A | | 6/1997 | Obermaier | |
| 5,678,265 | A | | 10/1997 | Meyer | |
| 5,881,407 | A | | 3/1999 | Chu Pt | |
| 6,015,471 | A | | 1/2000 | Rimington et al. | |
| 6,089,668 | A | * | 7/2000 | Peterson | 297/452.41 |
| 6,185,765 | B1 | * | 2/2001 | High | 5/419 |
| 6,216,299 | B1 | * | 4/2001 | Kohlman | 5/654 |
| 6,413,194 | B1 | | 7/2002 | Gant | |
| 6,782,573 | B2 | | 8/2004 | Odderson | |
| 6,826,795 | B2 | | 12/2004 | Wilkinson | |
| 7,000,276 | B2 | | 2/2006 | Chaffee | |
| 7,024,714 | B1 | | 4/2006 | Yates | |
| 7,048,703 | B2 | | 5/2006 | Riach | |
| 7,114,783 | B2 | | 10/2006 | Warren et al. | |

* cited by examiner

*Primary Examiner*—Michael Trettel
(74) *Attorney, Agent, or Firm*—Wood, Herron & Evans, LLP

(57) ABSTRACT

A set of inflatable, tubular, and concentric tubes or air bladders are placed in a bedding or seating product and adjusted to meet the preferences of a user. The tubes are arranged concentrically with the innermost tube defining an aperture at the center of the product. The tubes are connected to air supply hoses that are inflated through activation of an electronically controlled air pump. The flow may be controlled by solenoid or other valves. The user via a remote may control the inflation of one or more of the tubes to provide the optimum level of comfort to the user.

16 Claims, 2 Drawing Sheets

BEDDING OR SEATING PRODUCT HAVING INFLATABLE CONCENTRIC AIR BLADDERS

TECHNICAL FIELD

This invention relates generally to bedding or seating products and more particularly to such products containing multiple pneumatic bladders.

BACKGROUND

Manufacturers of furniture, particularly seating furniture, such as recliners and couches, are constantly striving to improve the comfort of their products. One known way of increasing the comfort of a seating product is to incorporate an air bladder into the seat of the product. Air bladders have been used to improve the comfort of seat cushions in earlier furniture designs.

As one example, U.S. Pat. No. 5,500,965 to Hannagan et al. discloses a wheelchair including a cushion having a plurality of inflatable bladders or tubes. The tubes are inflated to increase the comfort of the person using the wheelchair. Similarly, U.S. Pat. No. 5,634,223 to Obermaier discloses a hollow body for use as a seat pad. The hollow body ergonomically supports a favorable sitting position for the person seated thereon.

In addition, multiple bladders or bladder sections have been used to improve seating comfort. For example, U.S. Pat. Nos. 6,413,194 and 4,445,240 each disclose one inflatable bladder at least partially surrounding another independently inflatable bladder.

While these designs may have improved comfort, many drawbacks still exist. For instance, partially inflated existing air bladders require time for a user to get settled in his or her seat. Many times the prior art bladders have not optimized comfort because effort is needed to stay seated and prevent "roll" of the seated person. The bladders are usually shaped like a balloon or football and the seated person "rolls" around those bladders that protrude upwards from the seat like a bump or hill. The inflatable aspect of the bladder may improve comfort; however, the design of the bladder still results in uncomfortable feelings like "roll." In addition, the prior art bladder designs may be unsightly. A large lump in the middle of the seat does not provide an attractive place to sit and may create the appearance of a bulging balloon.

Accordingly, it is one object of the invention to provide an inflatable bladder design that improves comfort.

It is another object of the invention to provide an inflatable bladder design that reduces or eliminates "roll" of the seated person.

Another object of the invention is to improve the aesthetic appearance of the bladder design to a potential user.

SUMMARY

The bedding or seating product of the present invention which accomplishes these objects comprises multiple inflatable air bladders arranged in a concentric pattern. The product may also include layers of foam and/or fiber wrapped in an upholstered covering.

More particularly, the product comprises a first inflatable air bladder having a picture frame configuration and defining a first central aperture which is rectangular in shape. A second inflatable air bladder having a picture frame configuration is positioned concentrically interior to the first inflatable air bladder and defines a second aperture smaller than the first aperture, but similar in shape. The second air bladder is smaller in size than the first air bladder, even though each has the same general configuration.

The bedding or seating product may also include a third generally tubular inflatable air bladder positioned concentrically interior to the second generally tubular inflatable air bladder. The third and smallest generally tubular inflatable air bladder defines a third aperture at the center of the product. Any number of similar concentric inflatable air bladders may be incorporated into the product.

Each of the bladders may be independently controlled i.e. inflated and deflated with a desired amount of air. When each of the bladders is deflated, the bedding or seating product assumes the appearance of a product having no air bladders because the deflated bladders do not overlap. When inflated in a customized manner, the product assumes the desired degree of firmness fit to a particular user. When inflated, each of the air bladders assumes a generally tubular shape or configuration.

The bedding or seating product includes a set of concentric inflatable air bladders having a generally rectangular or picture frame-like shape. Each air bladder defines an aperture of a similar shape. The bedding or seating product also includes a set of air supply hoses each connected to a respective inflatable air bladder. Air flows through the hoses into the concentric inflatable air bladders. In addition, air flow into or out of each of the hoses may be separately and independently controlled by a solenoid air valve for controlling the flow of air towards the concentric air bladders. The air supply system used in the product also includes an electric air pump for providing a source of pressurized air to the concentric inflatable air bladders. Additionally, the system includes an electronic control unit for electronically controlling the operation of the electric air pump and the solenoid air valves. The air supply system may be controlled via a remote or any known method.

DETAILED DESCRIPTION OF THE DRAWINGS

Figure 1:
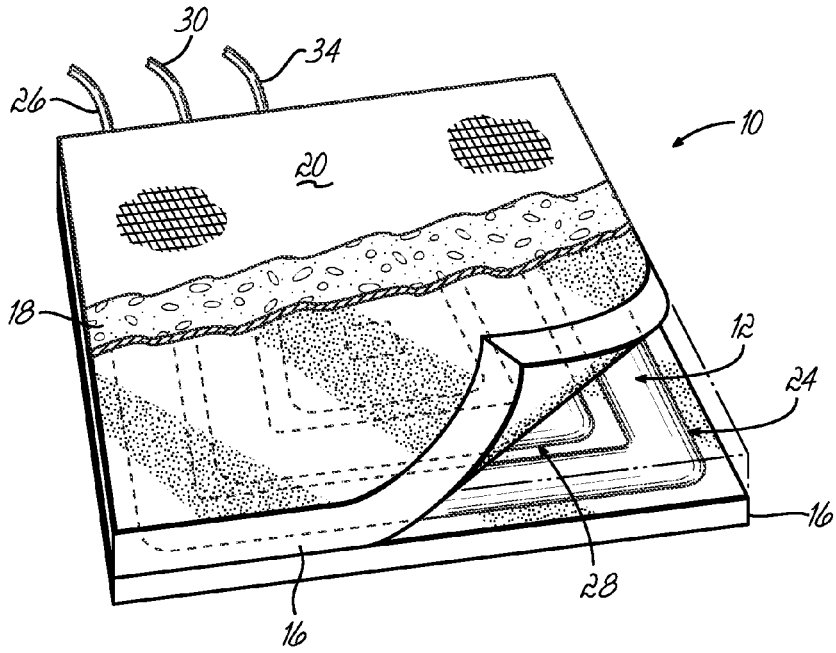
FIG. 1 is a perspective view of a cushion made in accordance with one aspect of the present invention.

Referring now to FIG. 1, a seating product or cushion 10 is illustrated having a central core 12 comprising a plurality of concentric inflatable air bladders 14. Although three inflatable air bladders 14 of generally the same configuration but differing in size are illustrated, any number of concentrically arranged inflatable air bladders may be incorporated into the product. One or more layers of foam 16 lay above and below the core 12. One or more fiber layers 18 overlay the foam layers 16. The core 12, foam layers 16 and fiber layers 18 are surrounded by an upholstered covering material 20, as is conventional.

Figure 2:
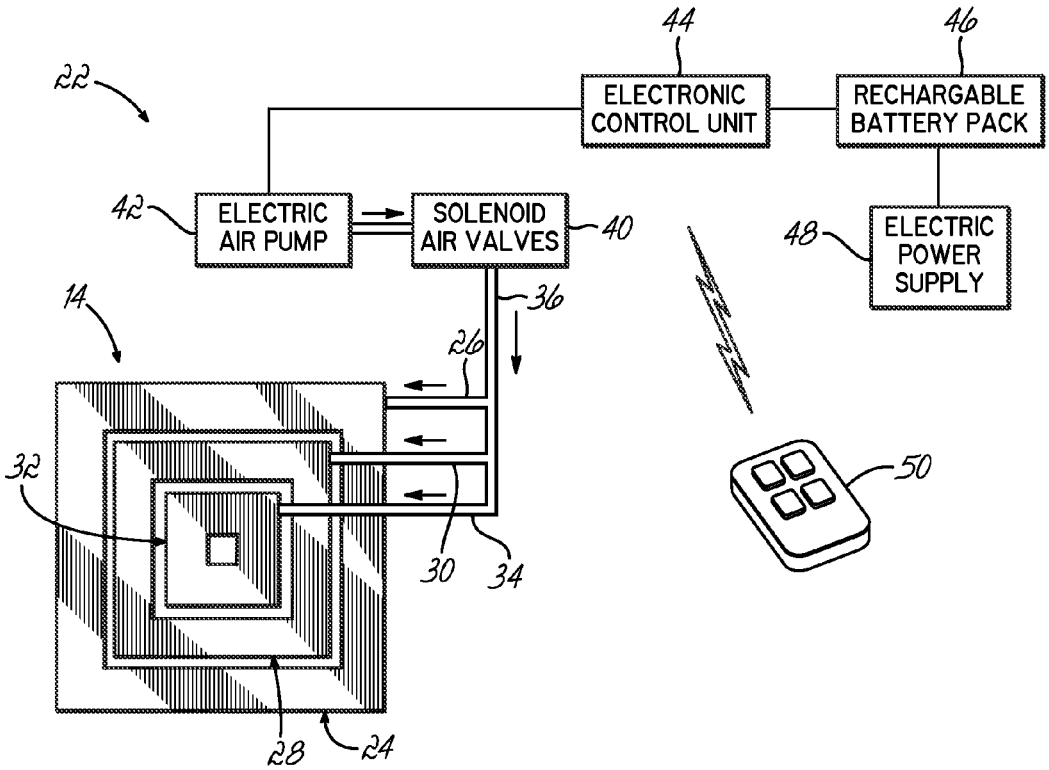
FIG. 2 is a schematic view of an air seating system utilizing the cushion of FIG. 1.

FIG. 2 illustrates an air control system 22 that operates to adjust the firmness of the seating product 10 according to the preference of the user. The central core 12 is composed of a first inflatable air bladder 24 connected to a first air supply hose 26. The central core 12 further comprises a second inflatable air bladder 28 connected to a second air supply hose 30. The second inflatable air bladder 28 is positioned concentrically interior to the first inflatable air bladder 24. In addition, a third inflatable air bladder 32 is positioned concentrically interior to the second inflatable air bladder 28 and connected to a third hose 34. All three of the hoses, the first hose 26, the second hose 30, and the third hose 34 are all connected to a main hose 36. Air supply through each of the hoses is operatively controlled by solenoid air valves designated by the block 40. An electric air pump 42 provides a source of pressurized air to the set of concentric inflatable air bladders 24, 28, and 32. An electronic control unit 44 controls the electric air pump 42. The electronic control unit 44 therefore also electronically controls operation of the solenoid air valves 40. The electronic control unit 44 is powered by an optional rechargeable battery pack 46 that contains a plurality of batteries rechargeable by using an electric power supply 48. A remote control 50 may control one or more of these elements. The combination of these different elements provide a bedding or seating product that can be electronically adjusted in firmness accordance with the preference of the user.

Figure 3:
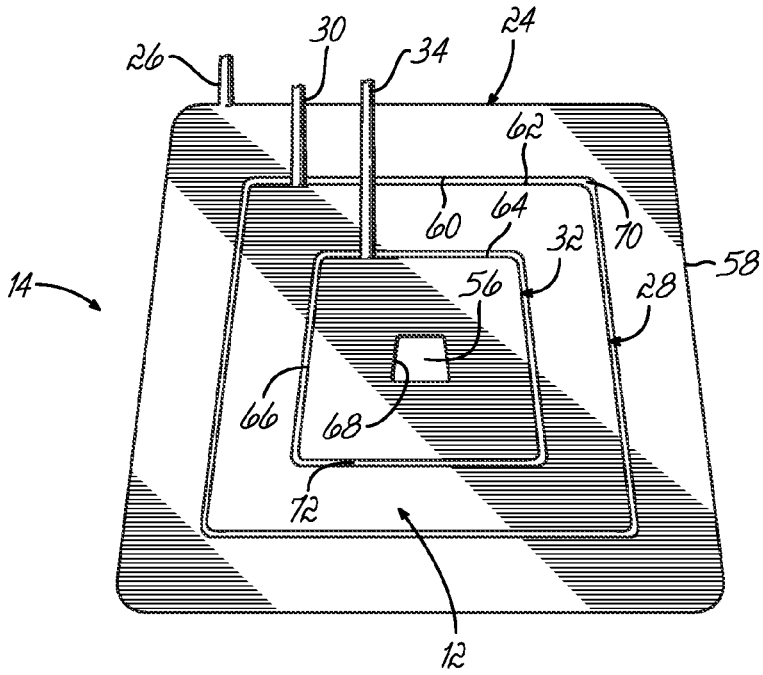
FIG. 3 is a perspective view of the inflatable air bladders of the cushion of FIG. 1 in a deflated condition.
Figure 4:
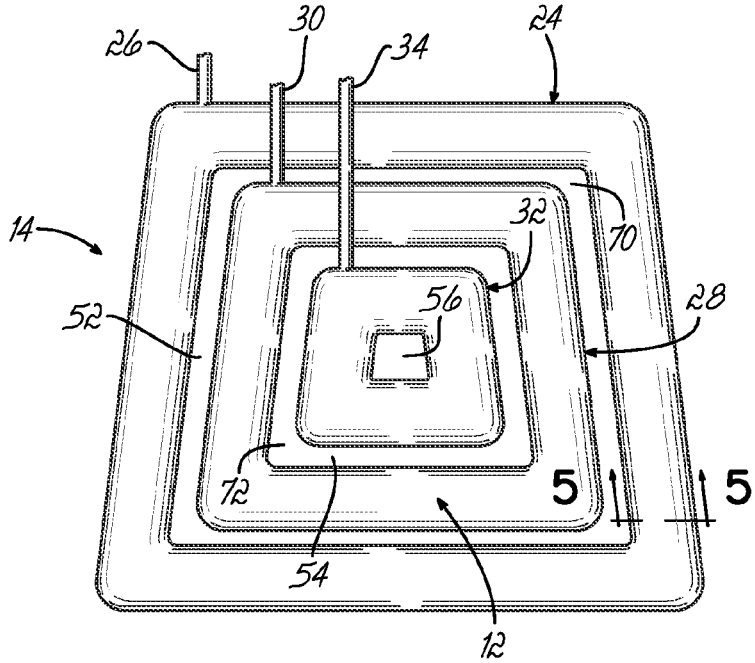
FIG. 4 is a perspective view of the inflatable air bladders of FIG. 3 in an inflated condition.

FIG. 3 illustrates the inflatable air bladders 24, 28, and 32 in a deflated condition so they are basically flat. The inflatable air bladders 24, 28, and 32 have a generally concentric arrangement, each having a picture frame configuration. The first inflatable air bladder 24 is the largest inflatable air bladder of the three and defines a first generally rectangular aperture or opening 52, as shown in FIG. 4. The second inflatable air bladder 28, also having a picture frame configuration, is located entirely inside the first aperture 52. This second inflatable air bladder 28 is the second largest inflatable air bladder of the three inflatable air bladders and defines a generally rectangular second aperture or opening 54 which is smaller in size than the first aperture or opening 52. The third inflatable air bladder 32, also having a picture frame configuration, is located entirely inside the second central aperture 54. This third inflatable air bladder 32 is the smallest inflatable air bladder of the three air bladders and defines a third central aperture or opening 56. This central aperture 56 is the smallest of the three apertures or openings 52, 54 and 56.

Each inflatable air bladder is generally formed of a flexible airtight material. Different types of materials can be used including polyurethane or polyvinylchloride (PVC) or any other type of polymer, rubber, or other resilient material readily apparent to those skilled in this art.

FIG. 3 illustrates that the first inflatable air bladder 24 has a generally rectangular outer edge 58 around its perimeter and a concentric generally rectangular inner edge 60. In the illustrated embodiment, the first inflatable air bladder 24 is generally square shaped with rounded corners; however, it may be other sizes or shapes. FIG. 3 also illustrates that the second inflatable air bladder 28 has a generally rectangular outer edge 62 around its perimeter and a concentric generally rectangular inner edge 64. In the illustrated embodiment, this second inflatable air bladder 28 is generally square shaped with rounded corners; however, it may be other sizes or shapes. The smallest and third inflatable air bladder 32 has a generally rectangular outer edge 66 around its perimeter and a concentric generally rectangular inner edge 68. In the illustrated embodiment, the third inflatable air bladder 32 is generally square shaped with rounded corners; however, it may be other sizes or shapes. As shown in FIG. 3, a gap 70 exists between the inner edge 60 of the first inflatable air bladder 24 and the outer edge 62 of the second inflatable air bladder 28. Similarly, a gap 72 exists between the inner edge 60 of the second inflatable air bladder 28 and the outer edge 66 of the third and smallest inflatable air bladder 32. The gaps 70, 72 are illustrated being approximately the same width; however they may be different widths.

FIG. 4 illustrates the first, second and third inflatable air bladders 24, 28, and 32 inflated. The concentric boundary spaces or gaps 70 and 72 have grown larger between the inflatable air bladders 24, 28, and 32 upon inflation of the air bladders, as compared to as shown in FIG. 3. The increase in the size of the gaps 70 and 72 results from the air bladders assuming a generally tubular shape upon inflation.

Figure 5:
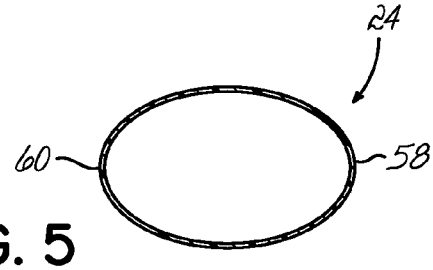
FIG. 5 is a view taken along the line 5-5 of FIG. 4.

As shown in FIG. 5, when inflated each air bladder assumes a configuration which is generally egg-shaped or elliptical. Each air bladder assumes a more convex outward shape thereby increasing the distances between the different air bladders 24, 28, and 32. The air bladders can be adjusted to inflate or deflate individually or separately according to the preference of the user. Accordingly, the user can achieve the optimal comfort for their body shape.

In operation, the operator may adjust the firmness of the pneumatic air bladders 24, 28, and 32 in order to conform to their preference. The user interfaces with the electronic control unit 44 sending signals to the electric air pump 42 and the solenoid air valves 40 to control the air supply that flows down through the main hose 38 and into the first, second and third hoses 26, 30, and 34. Air supplied by the electric air pump 42 and controlled by solenoid air valves inflates the different air bladders 24, 28, and 32 the desired amount. The concentric arrangement of the inflatable air bladders provides an adjustable arrangement that reduces roll and improves comfort. The different inflatable air bladders can be inflated and deflated separately in order to accommodate the preference of the user. When used in combination with upholstered foam, and/or fiber material a superior level of comfort can be achieved. In addition, the density or indentation load deflection of the foam can be varied based on the application. Moreover, the comfort can be personalized from one person to the next based on his or her own individual preferences. Although three concentric inflatable air bladders are illustrated, any number of air bladders arranged in such a concentric configuration may be used in accordance with this invention.

While I have described one single preferred embodiment of this invention, persons skilled in this art will appreciate that other embodiments may be utilized in the practice of this invention. Therefore, I do not intend to be limited except by the scope of the following appended claims.

What is claimed is:

1. A bedding or seating product comprising:

a first inflatable air bladder having a generally rectangular shape and defining a first central aperture;

a second inflatable air bladder having a generally rectangular shape positioned concentrically interior of the first inflatable air bladder and defining a second central aperture, wherein a gap exists between the first and second inflatable air bladders.

2. The product of claim 1, wherein each of the concentric air bladders has a picture frame configuration.

3. The product of claim 1, wherein each of the bladders may be independently inflated.

4. The product of claim 1, wherein the bladder material is formed of a flexible airtight material.

5. The product of claim 1 further comprising a third inflatable air bladder inside the second central aperture.

6. A bedding or seating product comprising:

a first generally tubular inflatable air bladder defining a first aperture;

a second generally tubular inflatable air bladder positioned concentrically interior to the first generally tubular inflatable air bladder inside said first aperture and defining a second aperture; and a third generally tubular inflatable air bladder defining a third aperture positioned concentrically interior to the second generally tubular inflatable air bladder inside the second aperture.

7. The product of claim 6, wherein each of the concentric air bladders has a picture frame configuration.

8. The product of claim 6, wherein the assembly is positioned inside the cushion between foam and fiber layers.

9. The product of claim 6, wherein the bladder material is formed of a flexible airtight material.

10. A bedding or seating product comprising:

a set of concentric inflatable air bladders, wherein each of the air bladders defines an aperture and a gap exists between adjacent air bladders;

a set of air supply hoses, each of said air supply hoses being connected to a respective inflatable air bladder; and an air supply, wherein each of the concentric inflatable air bladders are separately and independently inflatable.

11. A bedding or seating product comprising:

a set of concentric inflatable air bladders;

a set of air hoses each operatively coupled to a respective inflatable air bladder;

a set of solenoid air valves for controlling air flow into the concentric air bladders;

an electric air pump for providing a source of pressurized air to the concentric inflatable air bladders; and an electronic control unit for electronically controlling the operation of the electric air pump and the solenoid air valves.

12. A bedding or seating product comprising:

a first generally tubular inflatable air bladder;

a second generally tubular inflatable air bladder and positioned concentrically interior to the first generally tubular inflatable air bladder, wherein the second generally tubular inflatable air bladder defines an aperture and a gap exists between the first and second inflatable air bladders;

a layer of resilient foam material covering the top surface of the air bladders; and an upholstered covering material surrounding and encasing said cushion.

13. The product of claim 12, which further comprises a second layer of resilient foam material covering the bottom surface of said bladders.

14. The product of claim 12, which further comprises a layer of cushioning fiber material between the foam material and the upholstered covering material.

15. The product of claim 12, wherein the concentric air bladders generally define a square shape resulting in a picture frame global arrangement of the air bladders.

16. The product of claim 12, wherein the bladder material is formed of a flexible air tight material.

* * * * *